United States Patent [19]

Kesmodel

[11] Patent Number: 4,559,449

[45] Date of Patent: Dec. 17, 1985

[54] HIGH RESOLUTION PARTICLE SPECTROMETER

[75] Inventor: Lawrence L. Kesmodel, Bloomington, Ind.

[73] Assignee: Indiana University Foundation, Bloomington, Ind.

[21] Appl. No.: 613,151

[22] Filed: May 23, 1984

[51] Int. Cl.[4] ..... H01J 49/48; H01J 40/00

[52] U.S. Cl. ..... 250/305; 250/356 R; 313/361.1

[58] Field of Search ..... 250/396 R, 305, 310; 313/361.1

[56] References Cited

U.S. PATENT DOCUMENTS

| | | | |
|---|---|---|---|
| 3,448,263 | 6/1969 | Boutet et al. | 250/396 |
| 3,541,328 | 11/1970 | Enge | 250/396 |
| 4,300,045 | 11/1981 | Ibach | 250/305 |
| 4,412,131 | 10/1983 | Froitzheim | 250/305 |

OTHER PUBLICATIONS

"High Resolution Electron Loss Spectrometer ELS22", Leybold-Heraeus 64-600.2.

"A High Resolution Electron Energy Loss Spectrometer For Vibrational Surface Studies", Breet A. Sexton, J. Vac. Sci. Technol. 16, 1033 (1979), GMR-2920 Research Publication.

*Primary Examiner*—Bruce C. Anderson

*Attorney, Agent, or Firm*—Kirkland & Ellis

[57] ABSTRACT

A spectrometer for high-resolution particle energy loss spectroscopy is described. Specifically, the high-resolution particle energy loss spectrometer of the present invention comprises: source means for producing a collimated beam of particles; first stage monochromator means for selecting particles within a specified energy range; intermediate particle lens means for collimating, accelerating and decelerating the particles exiting from the first stage monochromator means; second stage monochromator means for selecting particles within a specified energy range; exit particle focusing means; input particle focusing means; cylindrical analyzer means for selecting particles with a specified energy range; and detector means for detecting impinging particles. The spectrometer described herein obtains higher system resolution at a given output current than other spectrometers known in the art.

5 Claims, 10 Drawing Figures

HIGH RESOLUTION PARTICLE SPECTROMETER

BACKGROUND OF THE INVENTION a. Field of the Invention

The present invention relates to an apparatus for spectroscopy, specifically for high resolution particle energy loss spectroscopy of samples.

b. Description of the Prior Art

Energy analyzers and spectrometers based on electrostatic energy dispersion of electrons and other charged particles are widely used in basic and applied science. High-resolution electron energy loss spectroscopy (EELS) methods employ a low-energy (1–20 eV) electron beam to detect quantum energy losses due to intrinsic surface vibrations (phonons), vibrations of adsorbed atomic or molecular species of thin film samples, or molecular vibrations in gaseous samples.

Spectrometers employed for high-resolution EELS known in the art have commonly been based on cylindrical (127°), spherical (180°) or cylindrical mirror (42°) analyzer designs. These instruments have been reviewed and their performance characteristics, including resolution and monochromatic current characteristics, have been discussed in Ibach and Mills, Electron Energy Loss Spectroscopy and Surface Vibrations (Academic, N.Y. 1982). Some prior art spectometers and methods purportedly have attained consistent system resolution of about 3.5 meV (measured in terms of energy width at half signal current, or abbreviated FWHM) in surface studies as described by Andersson and Persson in Phys. Rev. B 24, 3659 (1981) and by Lehwald and Ibach in *Vibration at Surfaces,* R. Caudano, J. M. Gilles and A. A. Lucas, eds. (Plenum, N.Y. 1982). Available data indicate that relatively high output currents at system resolutions of about 7–8 meV FWHM have been achieved by some spectrometers utilizing spherical designs, as described in J. E. Demuth, K. Christman and P. N. Sanda, Chem. Phys. Lett. 76, 201 (1980) and N. R. Avery, Appl. Surf. Sci. 13, 171 (1982). For the studies of thin films and of surface vibrations, it is desirable to maintain as high a monochromatic output current and pass energy at a given system resolution as possible. Heretofore, however, system resolution of about 2.5 meV at spectrometer pass energies of about 1.0 eV have not been obtainable by present spectrometers and known methods.

It is thus an object of the present invention to provide a spectrometer and methods for high resolution particle energy loss spectroscopy which obtain high monochromatic output currents from about 1.0 to $10.0\times10^{-10}$A while maintaining high energy spectrometer resolution between about 2.0 and 10 meV.

It is yet a further object of the present invention to provide an overall system resolution of about 3.0 meV while maintaining high signal levels and a spectrometer pass energy of about 1.0 eV. In addition, when lower pass energies are employed from about O.5 to about 1.0 eV, it is an object to maintain system resolution as high as about 2.5 meV.

It is yet another object of the present invention to provide a spectrometer utilizing a fixed geometry that affords compatibility with commercial surface analysis systems employing Auger electron spectroscopy (AES), photoelectron spectroscopy (ESCA), low-energy electron diffraction (LEED) and the like.

SUMMARY OF THE INVENTION

The present invention relates to a novel particle spectrometer specifically suited for high-resolution electron energy loss analysis as well as other types of particle spectroscopy. The high-resolution particle energy loss spectrometer comprises source means for producing a collimated beam of particles, first stage monochromator means for selecting particles within a specified energy range, intermediate particle lens means for focusing and collimating the particles exiting from the first stage monochromator means, second stage monochromator means for selecting particles within a specified energy range, exit particle focusing means, input particle focusing means, cylindrical analyzer means for selecting particles with a specified energy range, and detector means for detecting impinging particles.

The source means for producing a collimated beam of particles preferably comprises a filament for producing electrons, a lens for guiding electrons in substantially one direction, and at least five focusing and deflecting elements for in-plane and out-of-plane focusing of the electrons travelling in substantially one direction.

The intermediate particle lens means preferably comprises six focusing and deflection elements for both in-plane and out-of-plane focusing of particles exiting from the first stage monochromator means.

DETAILED DESCRIPTION OF THE INVENTION

Figure 1:
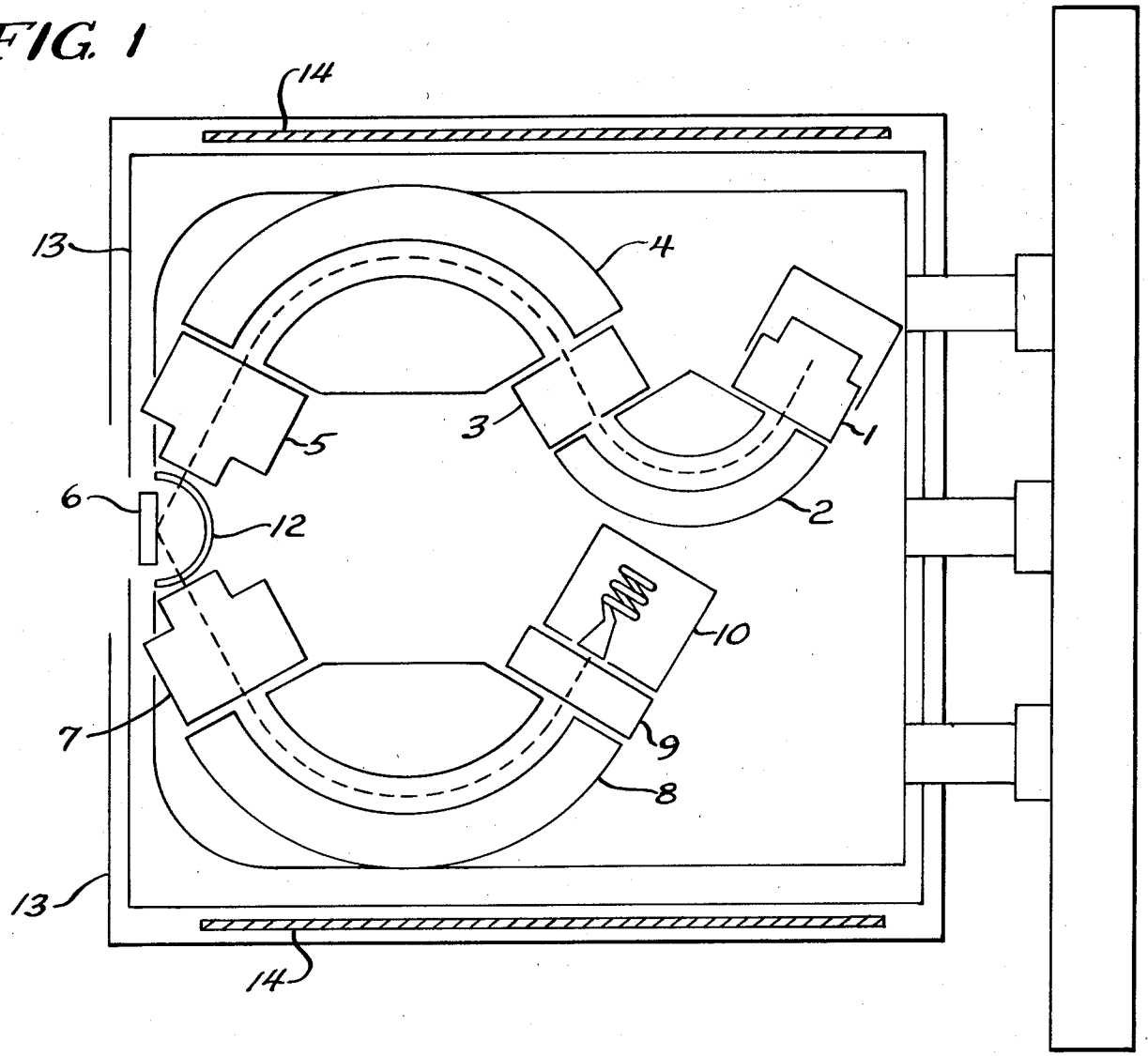
FIG. 1 is a schematic drawing of the high resolution particle energy loss spectrometer.

A schematic diagram of the spectrometer is shown in FIG. 1. The spectrometer is mounted on a standard base and is housed in a stainless-steel bell jar which are not shown. The system is pumped to less than about $1\times10^{-10}$ Torr by the use of suitable diffusion and sublimation pumps which are also not shown. The configuration shown in FIG. 1 allows convenient interface to AES, LEED, ESCA and other surface analysis components on the same level by sample translation and rotation on an appropriate sample manipulator. General spectrometer performance characteristics and experimental methods for the spectrometer of the present invention have bee described in J. Vac. Sci. Tech. A 1(3), 1456 (July–September 1983) and J. Chem. Phys. 79(9), 4646 (1983), which are incorporated herein by reference.

As shown schematically in FIG. 1 the spectrometer comprises: a particle source means 1; a monochromator system comprising a first stage monochromator 2; a second stage monochromator 4, and an intermediate lens systems 3; an exit lens 5; an input lens 7; a singlestage analyzer 8; exit slits 9; and a detector 10. The sample being studied may be mounted on a sample mount 6. As used herein, the term "particle" means substantially any charged particle, including protons, helium nuclei and electrons. The individual components of the spectrometer of the present invention are more fully described below.

For specular scattering (where the angle of incident particles is equal to the angle of particles selected for study) the beam strikes the sample on sample mount 6 at an angle of 62° from the surface normal. Although the spectrometer optics are rigid, off-specular scattering measurements may be performed by including a rock or tilt degree of freedom to the sample mount 6.

1. Particle Source Means

Figure 2:
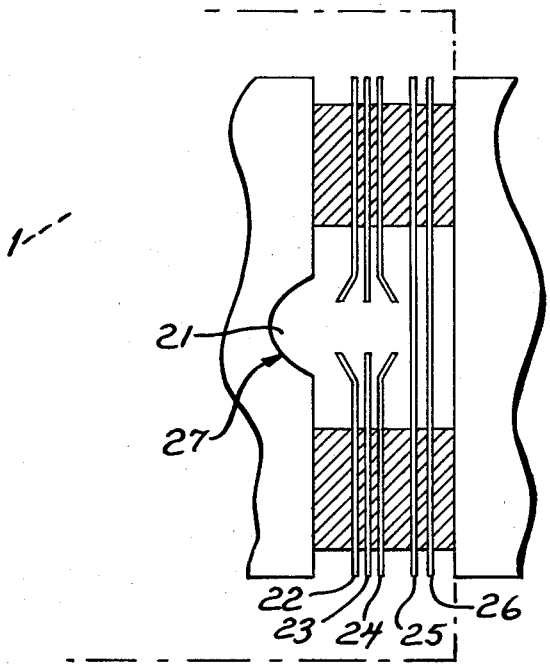
FIG. 2 is a schematic drawing of the particle source means of the spectrometer.

The particle source means 1, shown schematically in FIG. 2, introduces a focused and collimated beam of particles to the first stage monochromator 2. The particle source means 1 comprises an electron emitting cathode 21, a repeller lens 27 and five focusing and deflection elements 22–26. The electron emitting cathode 21 is preferably a tungsten filament. The repeller lens 27 guides the electrons from cathode 21 in substantially one direction. The electrons diverging from the repeller lens 27 must be suitably focused on the entrance slit of the first-stage monochromator 2. Focusing in the deflection plane of the monochromator (i.e., in the plane of FIG. 1) is hereinafter referred to as "in-plane focusing" (IPF) and focusing perpendicular to this plane is hereinafter referred to as "out-of-plane focusing" (OPF). In-plane focusing of the electrons by particle source means 1 onto the first stage monochromator entrance slit is accomplished by three focusing and deflection elements 22–24, which operate as a three-element einzel lens. Elements 22–24 are split as shown in FIG. 2 for deflection purposes. Elements 25 and 26 are split horizontally and operate as an OPF lens and focus electrons diverging from the cathode 21 in planes normal to the plane of FIGS. 1 and 2. Specifically, elements 25 and 26 are designed to focus the electrons into parallel trajectories as they pass through the entrance slit of the first stage monochromator 2. Thus, the elements 25 and 26 are of critical importance because they recover a large fraction of the current normally lost within the cylindrical monochromator system due to the inherent lack of OPF therein.

The embodiment show schematically in FIG. 2 and described above is a preferred embodiment for a particle source means 1 wherein the particles produced are electrons. Modifications may be made to the particle source means 1 for the use of other charged particles including protons and helium nuclei.

2. Monochromator System a. First and Second Stage Monochromators

The first stage monochromator 2 and the second stage monochromator 4 serve the same purpose; they provide means for selecting particles having substantially the same energy, that is, the particle beam is made as monochromatic as possible.

The basic equation governing the resolving power of the cylindrical spectrometer design with mean radius $R_o$ may be written as:

$$\frac{\Delta E}{E_o} = \frac{\Delta S}{R_o} + \frac{A^2}{3} + \frac{B^2}{4} \quad (1)$$

where $\Delta$ S is the slit width, $E_o$ is the spectrometer pass energy and A and B are semiangular divergences of the particle beam in the plane of FIG. 1 and perpendicular to that plane, respectively. Here $\Delta$ E is the FWHM of the monochromatic beam.

The preferred embodiment extracts a relatively high-current ($10^{-8}$A) but low-resolution electron beam from the first stage of the monochromator 2 and passes this beam via intermediate lens system 3 through the second stage 4 at high resolution. Preferred parameters selected for the first stage of the monochromator 2 are $\Delta S=0.5$ mm, $R_o=35$ mm; and for the second stage monochromator 4, $S=0.13$ mm, $R_o=60$ mm. The slit heights at the entrance to first stage and second stage are about 4 mm. In the first stage of monochromator 2 the A, B angles are not accurately defined, but in the second stage 4, A is set to less than 2.5° by a collimator slit 36 (shown in FIG. 3A) and B is negligible. Measured resolution values for the second stage 4 actually define an A of about 2.0° in conjunction with Equation (1) above.

The first and second stage monochromators (2, 4) may be optimized according to established principles. Fringing field corrections may also be made such that the total sector angle between slits equals the optimum cylindrical deflection analyzer focusing angle of 127°. Spurious relection from the dispersing elements was eliminated by milling a fine sawtooth corrugation in the sector walls. The use of the two-stage monochromator system circumvents problems of space charging which may occur at high feed currents in first stage monochromator 2 and provides a low spectral background.

b. Intermediate Lens System

An intermediate lens system 3 shown schematically in FIG. 1 is an integral part of the monochromator system and is used in collimating, accelerating and decelerating the particle beam emerging from the first stage monochromator 2 and entering second stage monochromator 4.

Figure 3A:
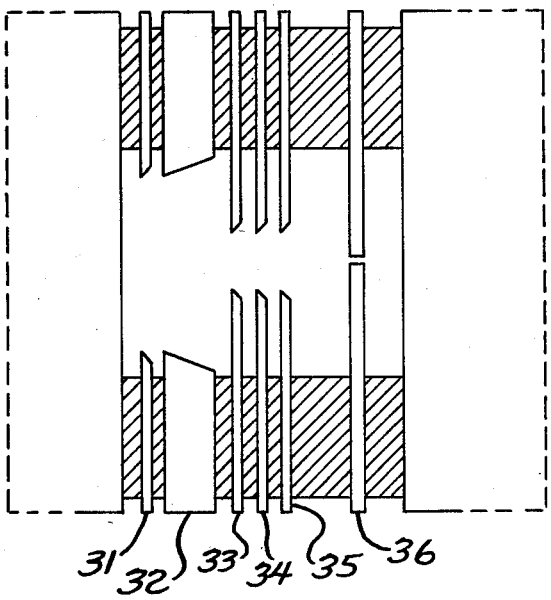
FIGS. 3A and 3B are schematic drawings of the intermediate lens system of the spectrometer.
Figure 3B:
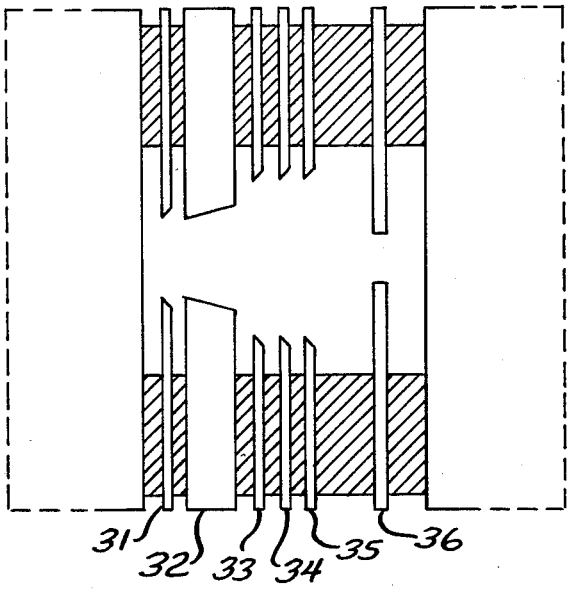

This collimation is necessary because the first stage monochromator 2 normally operates at higher energy than the second stage 4. This intermediate lens system 3 preferably comprises six focusing and deflection elements 31–36 as shown in FIGS. 3A and 3B. FIG. 3B is a view perpendicular to the view shown in FIG. 3A. Two focusing elements 31 and 32 operate predominantly as an OPF lens system and are used to focus particles diverging from the first stage monochromator 2, supplementing the purpose of the particle source means elements 25, 26. Elements 31 and 32, operating as an OPF lens, have proven to be critical for maximum monochromatic output current. Three focusing elements (33–35) operate as a IPF zoom lens to properly focus the beam on the entrance slit (not shown) of the second stage monochromator 4. The final element in intermediate lens system 3 is a collimation slit 36 positioned near the entrance slit of the second stage monochromator 4 so as to limit the entrance semiangle of the particle beam to less than about 2.5° under standard operating conditions.

Figure 4A:
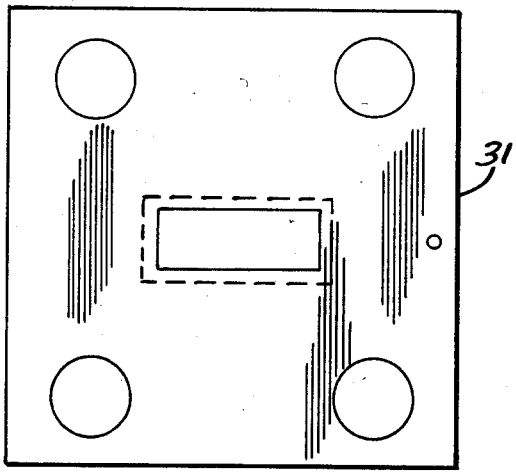
FIGS. 4A–4D are schematic drawings of the focusing and deflecting elements of the intermediate lens system assembly.
Figure 4B:
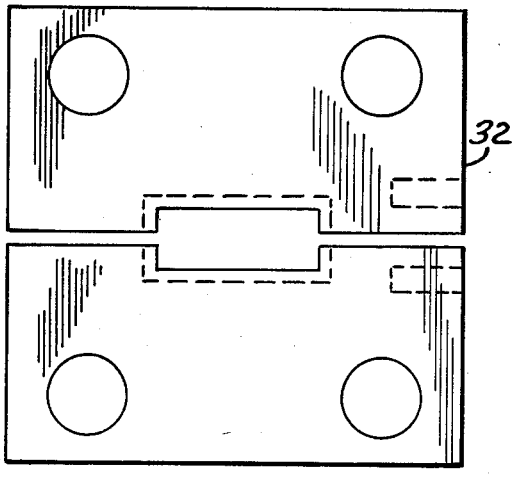
Figure 4C:
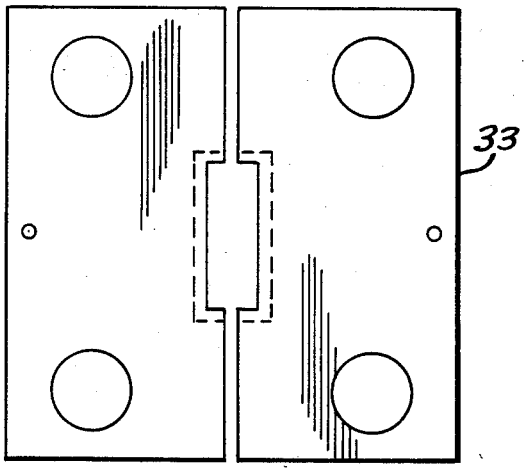
Figure 4D:
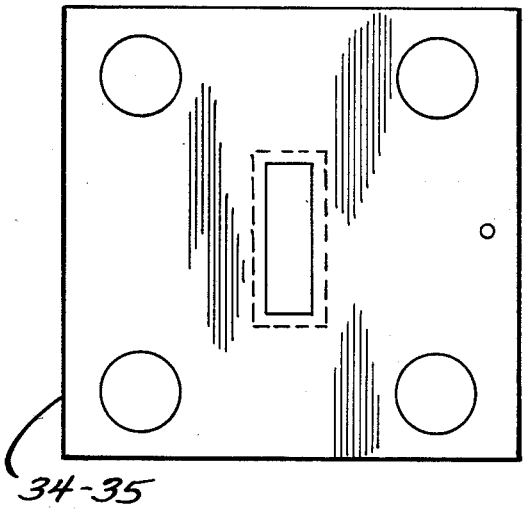

Out-of-plane focusing elements 31 and 32 are elongated in the horizontal direction as shown in FIGS. 4A and 4B. Element 32 is split as shown in FIG. 4B for deflection purposes. In-plane focusing elements 33–35 are elongated in the vertical direction as shown in FIGS. 4C and 4D. Element 33 is split vertically for deflection purposes.

3. Exit-Input Lenses

As shown schematically in FIG. 1 symmetric sets of exit lenses 5 and input lenses 7 are used for accelerating and focusing the particle beam onto the sample on sample mount 6 and of the scattered electrons from the sample onto the entrance slit of the analyzer, respectively. Proper focusing is achieved with a three element zoom lens similar to the lenses employed by Roy et al., J. Phys. E 8, 109 (1975), which was designed and described by Read, J. Phys. E 3, 127 (1970). In the system of the present invention, one of these lenses is split to provide vertical deflection. The lens system also contains separate horizontal deflection lenses located near the slits. The input lenses 7 for analyzer 8 may be scanned at variable rates as the slit voltage is scanned. A grounded electrostatic shield 12 in the shape of a half-cylinder surrounds sample 6.

4. Analyzer and Detector

The analyzer 8 has sectors and slits which are identical to those of the second stage monochromator 4 and is most preferably a cylindrical deflection analyzer. Analyzer 8 also provides a means for selecting particles having substantially the same energy. After the final analyzer slit, the particle beam passes through a additional exit slit 9 which accepts only those particles which exit the analyzer 8 within a few degrees of the slit normal, thereby rejecting stray particles. Following this slit, the particles pass through a drift tube which shields the slits from the entrance cone of the particle multiplier and detector 10, which is biased above ground potential. The particle multiplier and detector 10 may be of the continuous dynode type.

5. Magnetic Shielding

Magnetic shielding of the instrument is accomplished with a cylindrical double layer of properly annealed mumetal 13 as shown schematically in FIG. 1. A copper winding 14 between the two layers provides for routine in-situ degaussing of the shields. The particle source means 1 is also held in a separate mumetal enclosure and oriented so as to minimize magnetic effects from cathode current.

6. Instrument Performance

The instrument of the present invention maintains a higher monochromatic current for a given energy resolution than devices known in the art. One preferred embodiment of the present invention obtains a resolution of about 3.4 meV at about $1.5\times10^{-10}$ A incident current and high signal levels ($10^5$–$10^7$ cps) for elastic beam reflection. A higher resolution of 2.5 meV (20 $cm^{-1}$) may be obtained but with substantial sacrifice of signal level. Spectra obtained from the spectrometer of the present invention illustrate very low background achieved at loss energies above 12 meV (100 $cm^{-1}$), and spurious background or "ghost" peaks are not detected. These considerations are believed critical for detecting weak energy loss features and for examining surface vibrational (phonon) features that may occur in the low (30–200 $cm^{-1}$) energy range.

Spectra may be taken under less favorable conditions, that is, with samples exhibiting optical non-uniformity, roughness from extended ion-bombardment-anneal cycles, and low reflectivity (0.01). Even though some degradation in resolution and background quality is observed in these spectra, favorable counting rates are maintained.

Figure 5:
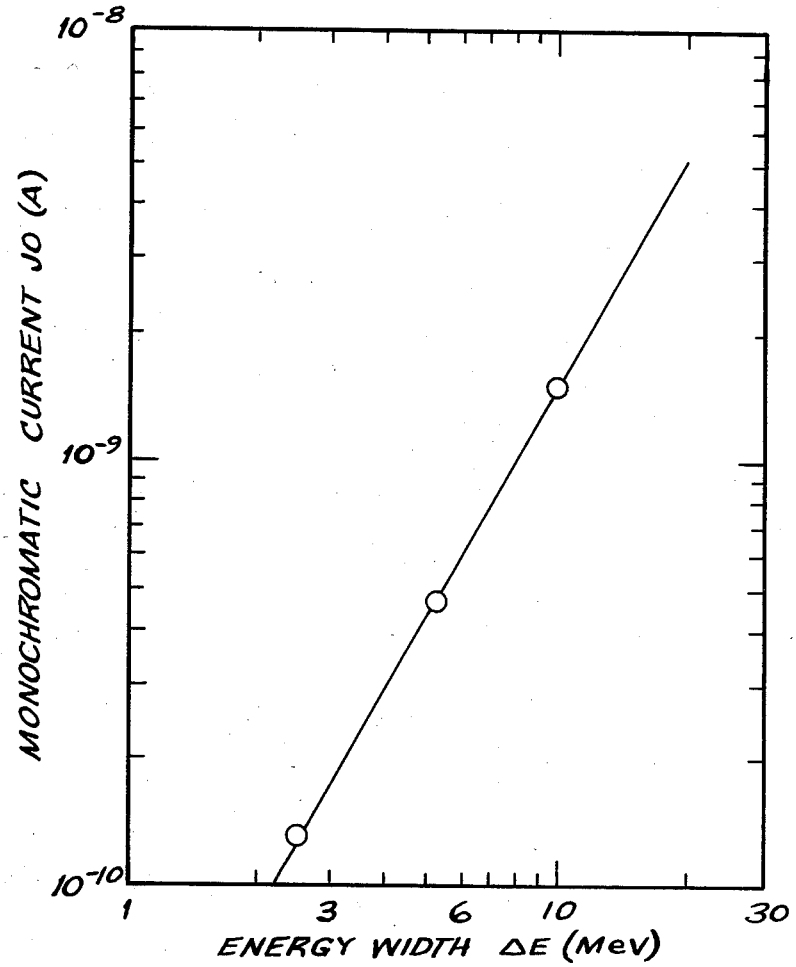
FIG. 5 is a monochromatic output current of the second stage monochromator as a second-power function of energy width (FWHM)$\Delta$ E.

Spectrometer performance in terms of monochromatic current ($j_o$) versus resolution ($\Delta E$) is illustrated by FIG. 5 which presents a log-log plot of experimental results and indicates an approximate second power energy law. The present results given in FIG. 5, however, generally exceed those reported for other spectrometers, even for the spherical systems which commonly exhibit higher output currents than cylindrical systems. In terms of ultimate resolution, a value of at least 2.5 meV FWHM may be achieved at a pass energy of about 0.5 eV. These results have been heretofore unknown.

EXAMPLE I

Acetylene Chemisorption on Pd (100)

Information on the structure and bonding of atomic and molecular adsorbates on surfaces may provide a basis for understanding processes such as heterogeneous catalysis. As described herein, the chemisorption and surface reactions of acetylene on palladium (100) may be studied with the spectrometer of the present invention.

Figure 6:
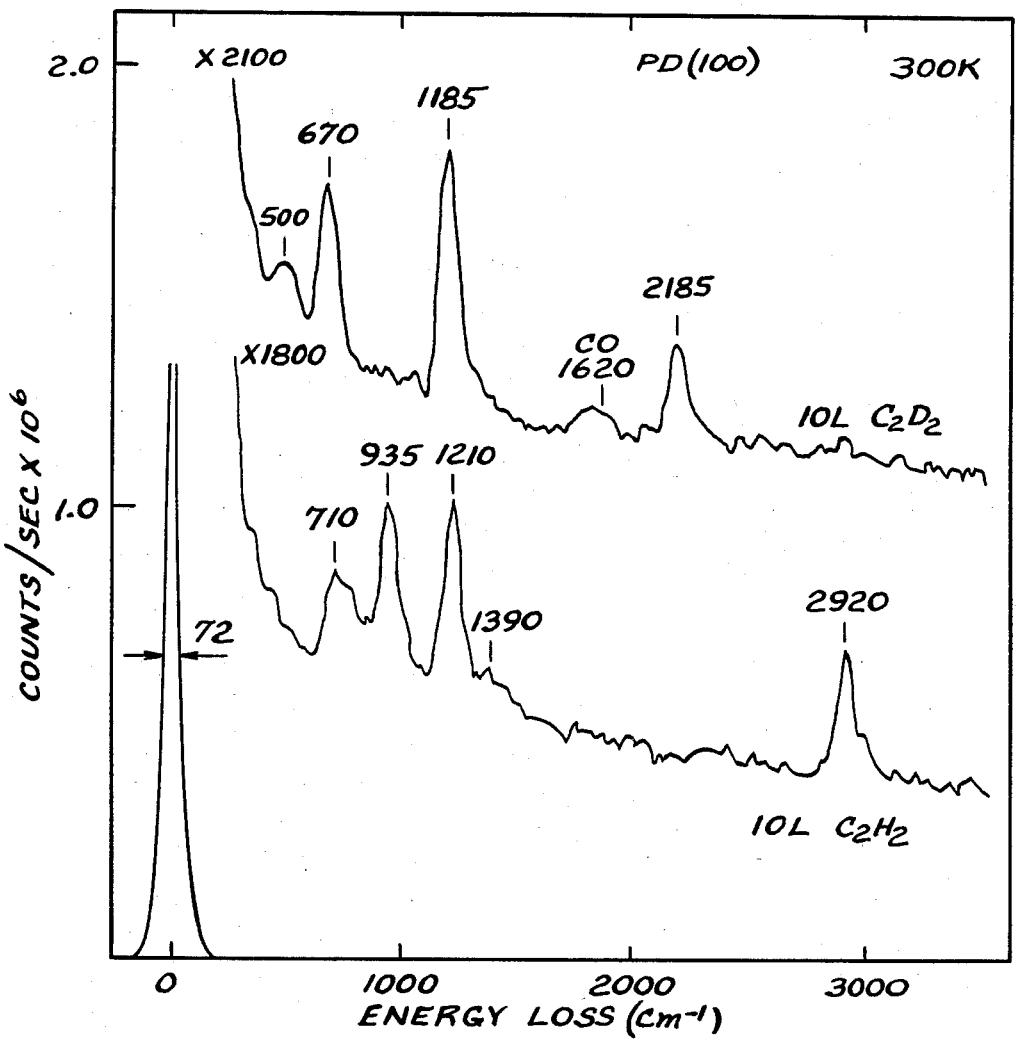
FIG. 6 is an energy loss spectrum obtained from Pd(100) surface with adsorbed acetylene and perdeuteroacetylene.

In the present example the system was evacuated to about $5\times10^{-11}$ Torr through the use of suitable diffusion and sublimation pumps. Because high sensitivity is desirable due to the low intensity of the $C_2H_2$ modes, the spectrometer resolution was set at about 60 $cm^{-1}$ for a pass energy of about 2.0 eV. Count rates for specular scattering routinely exceeded $10^6$ cps for acetylene adsorption at beam energy of 5 eV. High resolution spectra of acetylene and perdeuteroacetylene exposed at room temperature to a Pd (100) surface (See FIG. 6) may be obtained with the spectrometer of the present invention.

The foregoing is intended as an illustration of the device of the present invention and is not intended to limit its scope. As one skilled in the art would recognize, many modifications may be made to the present invention which fall within its scope and spirit.

I claim:

1. A high-resolution particle energy loss spectrometer device comprising:

a. source means for producing a focused and collimated beam of particles;

b. first stage monochromator mean for selecting particles within a specified energy range exiting from the source means;

c. intermediate particle lens means for both in-plane and out-of-plane focussing for collimating, accelerating and decelerating the particles exiting the first stage monochromator means;

d. second stage monochromator means for selecting particles within a specified energy range from particles exiting the intermediate particle lens means;

e. exit lens means for focusing selected particles onto a sample;

f. input lens means for focusing particles deflected from the sample;

g. analyzer means for selecting particles within a specified energy range from particles exiting the input lens; and h. detector means for detecting particles exiting the analyzer means and impinging thereon.

2. A device, as claimed in claim 1, wherein the source means for producing a focused and collimated beam of particles comprises:

a. a filament for producing electrons;

b. a lens for guiding electrons in substantially one direction; and c. at least five focusing and deflecting elements for in-plane and out-of-plane focusing of the electrons travelling in substantially one direction.

3. A device, as claimed in claim 1, wherein the intermediate particle lens means comprises six focusing and deflection elements for both in-plane and out-of-plane focusing of particles exiting from the first stage monochromator means.

4. A device for producing a focused and collimated beam of particles comprising:

a. a filament for producing electrons;

b. a lens for guiding electrons in substantially one direction; and c. at least five focusing and deflecting elements for in-plane and out-of-plane focusing of the electrons travelling in substantially one direction.

5. A monochromator system comprising:

a. first stage monochromator means for selecting particles within a specified energy range;

b. intermediate particle lens means comprising at least six focusing and deflection elements for both in-plane and out-of-plane focusing for collimating, accelerating and declerating the particles exiting the first stage monochromator means; and c. second stage monochromator means for selecting particles within a specified energy range exiting from the intermediate particles lens means.

* * * * *

UNITED STATES PATENT AND TRADEMARK OFFICE

CERTIFICATE OF CORRECTION

PATENT NO. : 4,559,449

DATED : December 17, 1985

INVENTOR(S) : Lawrence L. Kesmodel

It is certified that error appears in the above-identified patent and that said Letters Patent is hereby corrected as shown below:

Column 5, Line 29, "through a" should be -- through an --

Column 6, Line 49, "mean" should be -- means --

Signed and Sealed this

Sixth Day of January, 1987

*Attest:*

DONALD J. QUIGG

*Attesting Officer*

*Commissioner of Patents and Trademarks*